US006905368B2

(12) United States Patent
Mashiyama et al.

(10) Patent No.: US 6,905,368 B2
(45) Date of Patent: Jun. 14, 2005

(54) CONNECTOR FOR USE WITH HIGH FREQUENCY SIGNALS

(75) Inventors: Jin-ichi Mashiyama, Tokyo (JP); Yukio Saitoh, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 10/699,163

(22) Filed: Oct. 31, 2003

(65) Prior Publication Data

US 2004/0092140 A1 May 13, 2004

(30) Foreign Application Priority Data

Nov. 13, 2002 (JP) ..... 2002-329195

(51) Int. Cl.[7] ..... H01R 13/648
(52) U.S. Cl. ..... 439/608; 439/108
(58) Field of Search ..... 439/608, 108

(56) References Cited

U.S. PATENT DOCUMENTS 5,743,765 A * 4/1998 Andrews et al. ..... 439/608
6,293,827 B1 * 9/2001 Stokoe ..... 439/608
6,435,913 B1 * 8/2002 Billman ..... 439/608
6,471,548 B2 * 10/2002 Bertoncini et al. ..... 439/608
6,540,558 B1 * 4/2003 Paagman ..... 439/608
6,544,072 B2 * 4/2003 Olson ..... 439/608
6,572,410 B1 * 6/2003 Volstorf et al. ..... 439/608
6,579,124 B1 * 6/2003 Vanbesien ..... 439/608
6,609,933 B2 * 8/2003 Yamasaki ..... 439/608
6,652,318 B1 * 11/2003 Winings et al. ..... 439/608
2004/0005815 A1 * 1/2004 Mizumura et al. ..... 439/608

* cited by examiner

*Primary Examiner*—Hae Moon Hyeon
(74) *Attorney, Agent, or Firm*—Baker Botts LLP

(57) ABSTRACT

An electrical connector includes a pin connector and a socket connector. The pin connector has a plurality of pin contacts, a required number of grand contacts and a block for holding the pin and ground contacts. The socket connector has a plurality of socket contacts, a required number of ground contacts and a housing for holding the socket and ground contacts. The block and housing are each formed from an insulating plastic material and formed with contact insertion apertures into which the contacts are inserted and fixed. Further, the block and housing each have metallized surfaces around the contact insertion apertures in a manner to electrically insulate these contact insertion apertures for pin and socket contacts independently from one another. The electrical connector thus constructed is easily and economically manufactured while being capable of achieving sufficient shielding effect leading to sufficiently high speed transmission.

11 Claims, 5 Drawing Sheets

CONNECTOR FOR USE WITH HIGH FREQUENCY SIGNALS

BACKGROUND OF THE INVENTION

The present invention relates to an electrical connector for use in electric or electronic appliances, and more particularly to an electrical connector with signal contacts and ground contacts improved in arrangement and construction for use in high speed transmission.

There is disclosed in Japanese Patent Application Opened No. 2000-507,740 an electrical connector assembly including an insulating housing, a plurality of terminal modules incorporated therein and conductive shields therebetween. Each of the terminal modules includes a plurality of contacts each of which consists of a fitting contact portion, a conductor connection portion and an intermediate portion therebetween, the intermediate portion being completely or partly enclosed and held in an insulating web. Each of the modules has a conductive shield attached thereto.

With this connector assembly, each shield at least includes a first elastic arm adapted to be brought into electrical contact with one contact selected from contacts in the terminal module to which the shield is secured, and a second elastic arm outwardly extending from the adjacent terminal module and adapted to be brought into electrical contact with one contact selected from contacts in the adjacent terminal module.

For the purpose of providing an electrical connector with ground contacts to be easily manufactured, disclosed in Japanese Patent Application Opened No. 2002-50,436 is a connector having a plurality of signal contacts arranged in a predetermined plane and ground contacts arranged between the signal contacts, these contacts being held in an insulator. The insulator is provided on its specific surface with a ground plate secured thereto and is formed with windows through which parts of the ground contacts and parts of the signal contacts adjacent thereto are exposed, the ground plate having contact portions adapted to contact the ground contacts through the windows.

These known connectors disclosed in the two patent literatures are intended to adapt to the high speed transmission and have an object to reduce the cross talk between signals passing through a plurality of signal contacts.

Moreover, a prior art proposal has attempted to reduce the cross talk by arranging contacts in a particular arrangement as shown in FIG. 5. In more detail, signal contacts ($+S_1$, $+S_2$, $+S_3$ . . . ), phase inversion signal contacts ($-S_1$, $-S_2$, $-S_3$ . . . ), and ground contacts (G) are arranged in a manner that ground contacts (G) surround a pair of contacts $+S_1$ and $-S_1$, a pair of contacts $+S_2$ and $-S_2$, a pair of contacts $+S_3$ and $-S_3$, . . . As can be seen from FIG. 5, it may be recognized in this arrangement that the ground contacts are arranged between pairs of contacts, each pair consisting of a signal contact and a phase inversion signal contact.

The connectors disclosed in the above patent literatures and the prior art proposal are beneficial to some extent for obtaining high shielding effect and high speed transmission.

With the case of arranging ground contacts between pairs of signal contact and phase inversion signal contact, if a pitch between the contacts is very narrow, clearances between the ground contacts would unavoidably become large. In the connectors disclosed in the Japanese Patent Application Opened Nos. 2000-507,740 and 2002-50,436, it is also unavoidable to enlarge clearances between the shielded signal contacts to some extent, so that sufficient shielding effect could not be obtained. As a result, the transmission speed would be limited to the order of several hundreds Mbps, which would not fully comply with imposed requirement of even higher speed transmission in future. Whereas efforts to date have been beneficial, technical problems remain to be solved.

With the connectors disclosed in the patent literatures described above, the number of parts inevitably increases so that the cost would go up concerning their management and fabrication.

SUMMARY OF THE INVENTION

In view of the above problems with the prior art, it is an object of the invention to provide an electrical connector which is easily and economically manufactured and capable of achieving sufficient shielding effect to fulfill the requirement of higher speed transmission.

In order to accomplish the above object, in an electrical connector comprising a pin connector and a socket connector, the pin connector including a plurality of pin contacts, a required number of grand contacts and a block for holding the pin and ground contacts, and the socket connector including a plurality of socket contacts, a required number of ground contacts and a housing for holding the socket and ground contacts, according to the invention the block and housing are each formed from an insulating plastic material and formed with contact insertion apertures into which the contacts are inserted, and the block and housing each have metallized surfaces around the contact insertion apertures in a manner to electrically insulate these insertion apertures for pin and socket contacts independently from one another.

By metallizing the surfaces around the contact insertion apertures, clearances between the shield layers can be reduced.

In a preferred embodiment, the block of the pin connector is formed with grooves on either, or both, of the fitting side of the block and the connecting side to a board to make independent the pin contacts from one another, while the block is provided with at least one groove around the ground contacts and with at least one further groove to communicate the at least one groove with the contact insertion apertures for the ground contacts. Moreover, the housing of the socket connector is formed with grooves on the fitting side of the housing to make independent the socket contacts from one another, while the housing is provided with at least one groove around the ground contacts.

Preferably, the block of the pin connector is metallized on its surfaces around the contact insertion apertures for the pin contacts, while the ground contacts are each arranged between the pin contacts in columns or rows. Further, the housing of the socket connector is metallized on its surfaces around the contact insertion apertures for the socket contacts, while the ground contacts of the socket connector are arranged in positions corresponding to those of the ground contacts of the pin connector.

In another embodiment, the pin contacts of the pin connector form respective pairs of pin contacts, each consisting of the two pin contacts, and the block of the pin connector is formed with grooves on either, or both, of the fitting side of the block and the connecting side of a board to make independent the pairs of pin contacts from one another, while the block is provided with at least one groove around the ground contacts and with at least one further groove to communicate the at least one groove with the contact insertion apertures for the ground contacts. Moreover, the socket contacts of the socket connector form respective pairs of socket contacts, each consisting of the two socket contacts, and the housing of the socket connector is formed with grooves on the fitting side of the housing to make independent the pairs of socket contacts from one another, while the housing is provided with at least one groove around the ground contacts.

Preferably, the block of the pin connector is metallized on its surfaces around pairs of the contact insertion apertures for the pin contacts, while the ground contacts are each arranged between two pairs of pin contacts in columns and rows. Moreover, the housing of the socket connector is metallized on its surfaces around pairs of the contact insertion apertures for the socket contacts, while the ground contacts of the socket connector are arranged in positions corresponding to those of the ground contacts of the pin connector.

In a further embodiment, the pin contacts of the pin connector form respective sets of pin contacts, each consisting of a plurality of the pin contacts, and the block of the pin connector is formed with grooves on either, or both, of the fitting side of the block and the connecting side to a board to make independent the sets of the pin contacts from one another, while the block is provided with at least one groove around the ground contacts and with at least one further groove to communicate the at least one groove with the contact insertion apertures for the ground contacts. Further, the socket contacts of the socket connector form respective sets of the socket contacts, each consisting of a plurality of the socket contacts, and the housing of the socket connector is formed with grooves on the fitting side of the housing to make independent the sets of the socket contacts from one another, while the housing is provided with at least one groove around the ground contacts.

Preferably, the block of the pin connector is metallized on its surfaces around sets of the contact insertion apertures for the pairs of pin contacts, while the ground contacts are each arranged between two sets of the pin contacts in columns and rows. Moreover, the housing of the socket connector is metallized on its surfaces around sets of the contact insertion apertures for the sets of socket contacts, while the ground contacts of the socket connector are arranged in positions corresponding to those of the ground contacts of the pin connector.

According to the invention, the housing of the socket connector comprises a main portion in the form of a substantially flat plate, and a plurality of projections extending from the main portion, the contact insertion apertures passing through the main portion and the projections, and the main portion and the projections are metallized on their substantially entire surfaces so as to allow the contact insertion apertures for the socket contacts to be electrically insulated independently from one another.

In an embodiment of the invention, the contact insertion apertures for the ground contacts only are metallized.

The metallization is here understood as signifying the condition of an insulator coated on its surface with a metal film so as to be electrically conductive.

The electrical connector thus constructed according to the invention can bring about the following significant effects.

(1) The metallization around the contact insertion apertures for the pin, socket and ground contacts according to the invention ensures the shielding effect to reduce the cross talk, thereby enabling the high speed transmission.

(2) According to the invention the pin contacts of the pin connector and the socket contacts of the socket connector form pairs of contacts, respectively, each pair consisting of a signal contact and a phase inversion signal contact, and the surfaces of the insulators around the contact insertion apertures for the pin and socket contacts are metallized. With such a construction, the shielding is securely effected to achieve higher speed transmission of more than several thousands Mbps.

(3) According to the invention, the block of the pin connector is formed with grooves on either, or both, of the fitting side of the block and the connecting side to a board to make the pin contacts independent from one another, while the block is provided with at least one groove around the ground contacts and with at least one further groove to communicate the at least one groove with the contact insertion apertures for the ground contacts. Further, the housing of the socket connector is formed with grooves on the fitting side of the housing to make the contact insertion apertures for the socket contacts independent from one another, while the housing is provided with at least one groove around the contact insertion apertures for the ground contacts. With this construction, the surfaces around the contact insertion apertures for the pin, socket and ground contacts are metallized to achieve the shielding effect with great certainty, thereby reducing the cross talk and realizing the higher speed transmission.

(4) According to the invention, the block of the pin connector is formed with the at least one further groove communicating the at least one groove with the contact insertion apertures for the ground contacts, thereby easily permitting the earthing of the ground contacts.

(5) According to the invention, by mere insertion of the ground contacts into the contact insertion apertures of the pin and socket connectors, the ground contacts can be readily earthed.

(6) The electrical connector according to the invention can be easily used as a signal transmission electrical connector having signal contacts and ground contacts in pairs by earthing the ground contacts in accordance with specifications of connectors.

The invention will be more fully understood by referring to the following detailed specification and claims taken in connection with the appended drawings.

DESCRIPTION OF THE PREFERRED EMBODIMENTS

Figure 1:
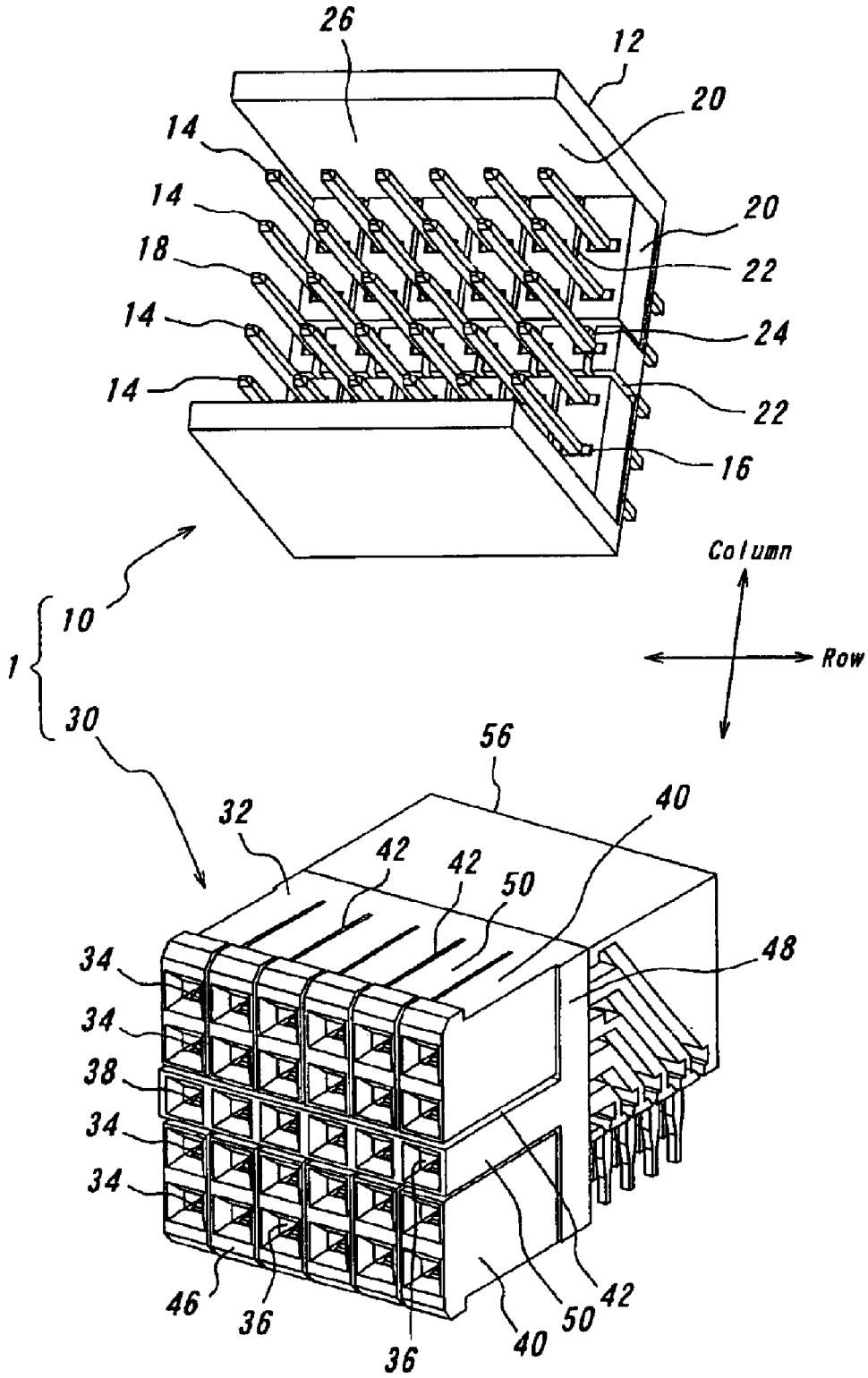
FIG. 1 is a perspective view illustrating a pin connector and a socket connector of an electrical connector according to the invention.

An electrical connector 1 according to the present invention comprises a pin connector 10 and a socket connector 30 as shown in FIG. 1. The pin connector 10 comprises an insulator or block 12 made of an insulating plastic material and pin contacts 14 and ground contacts 18 made of a metal. In a similar manner, the socket connector 30 comprises an insulator or housing 32 made of an insulating plastic material and socket contacts 34 and ground contacts 38 made of a metal.

These insulators are injection molded from an insulating plastic material. Preferred plastics from which to form these insulators include, but not limited to, polybutylene terephthalate (PBT), liquid crystal polymer (LCP), polyphenylene sulfide (PPS), polyamide (46PA or 66PA) and the like in view of the requirements imposed on the block and housing with respect to workability, dimensional stability and the like. The contacts are formed of a metal by the press-working in the conventional manner. Preferred metals for the contacts may include but not limited to brass, phosphor bronze, beryllium copper and the like with a view to obtaining the conductivity and springiness.

Figure 2:
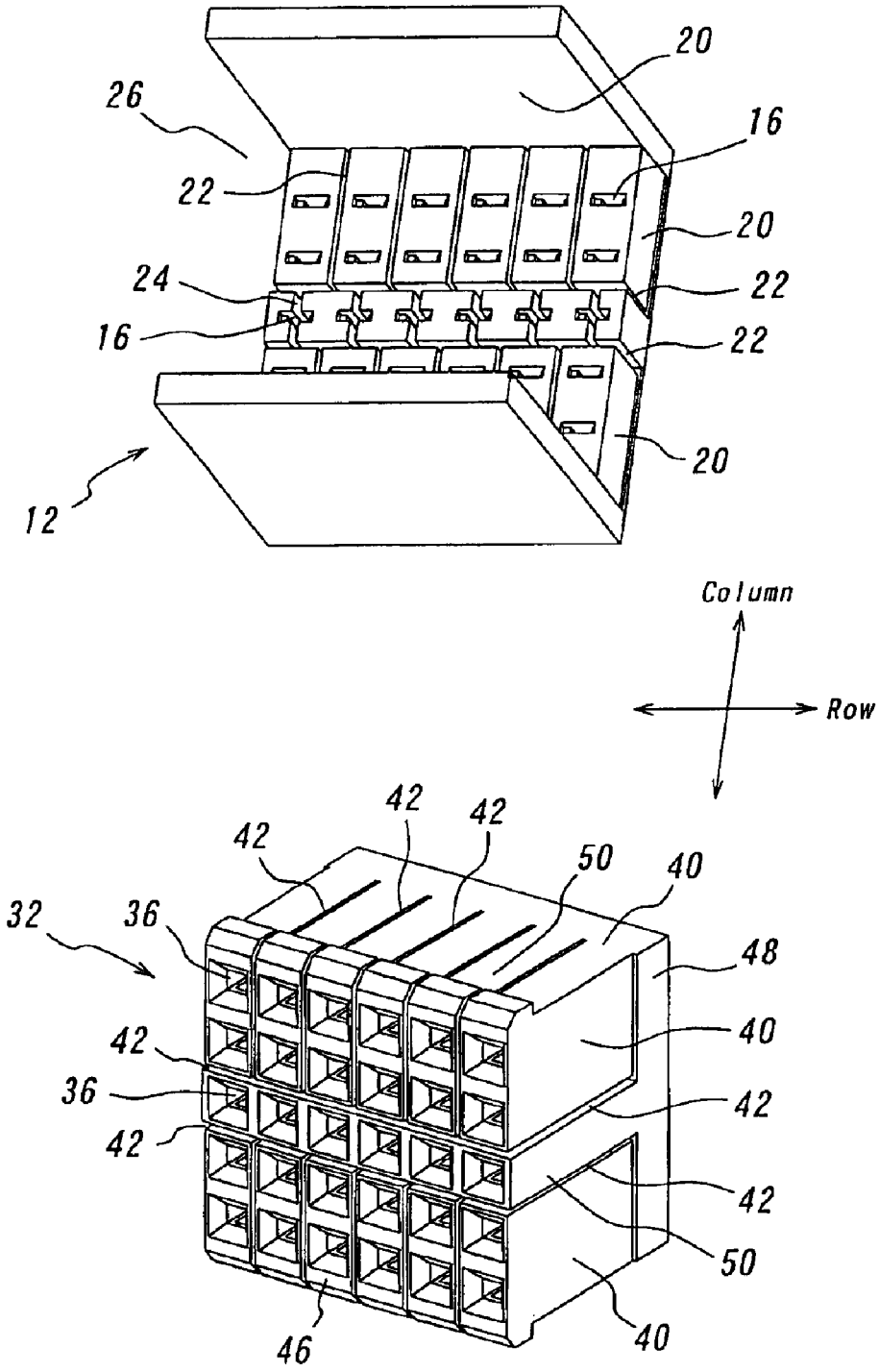
FIG. 2 is a perspective view illustrating the block and housing of the pin and socket connectors shown in FIG. 1.
Figure 3A:
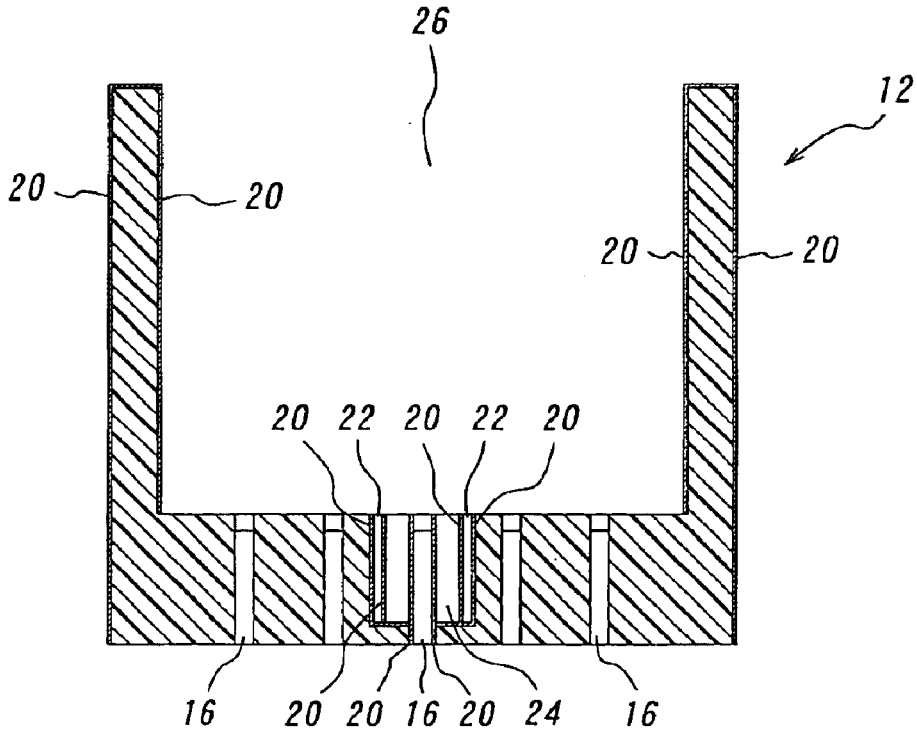
FIG. 3A is a sectional view of the block shown in FIG. 2 taken along a plane including the contact insertion apertures in a column.
Figure 3B:
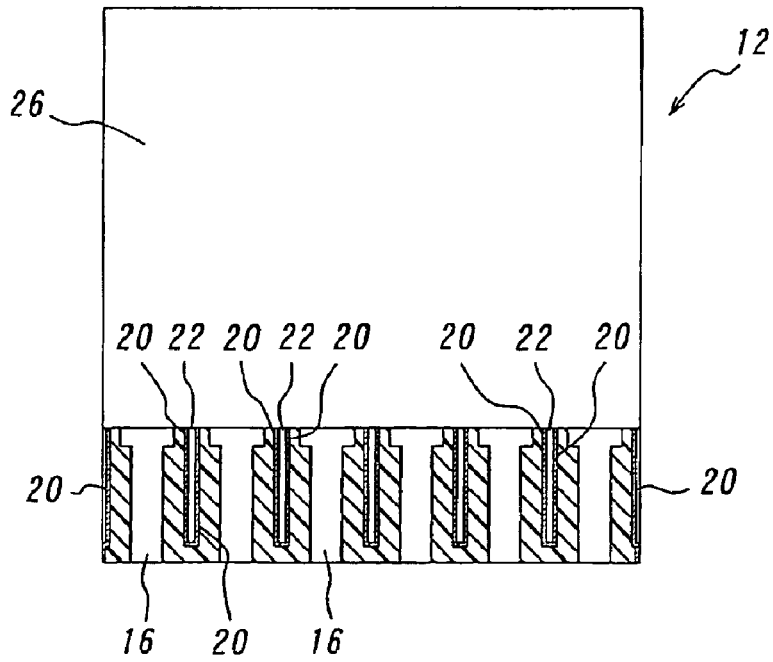
FIG. 3B is a sectional view of the block shown in FIG. 2 taken along a plane including the contact insertion apertures in a row.
Figure 4A:
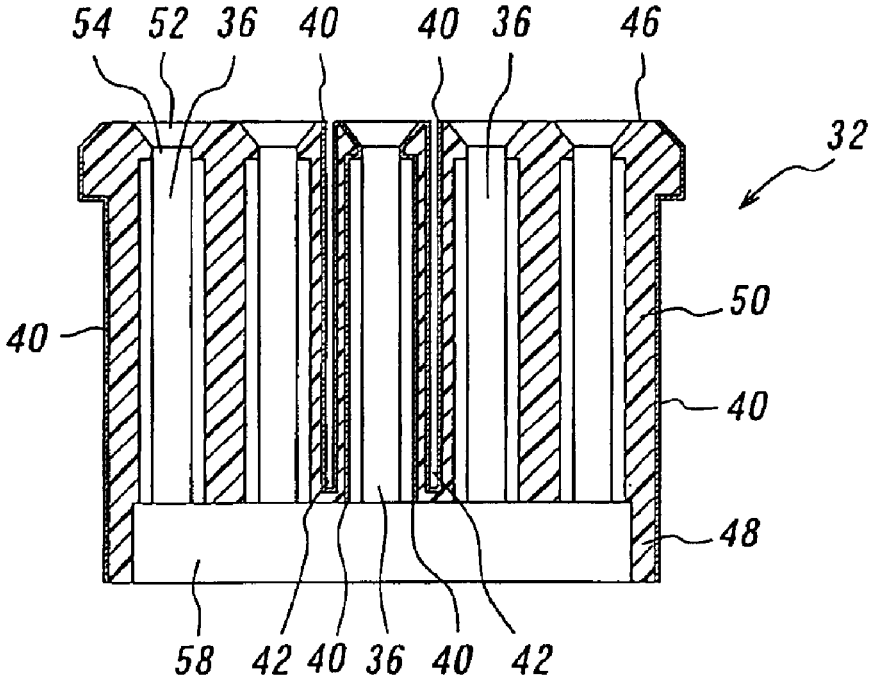
FIG. 4A is a sectional view of the housing shown in FIG. 2 taken along a plane including the contact insertion apertures in a column.
Figure 4B:
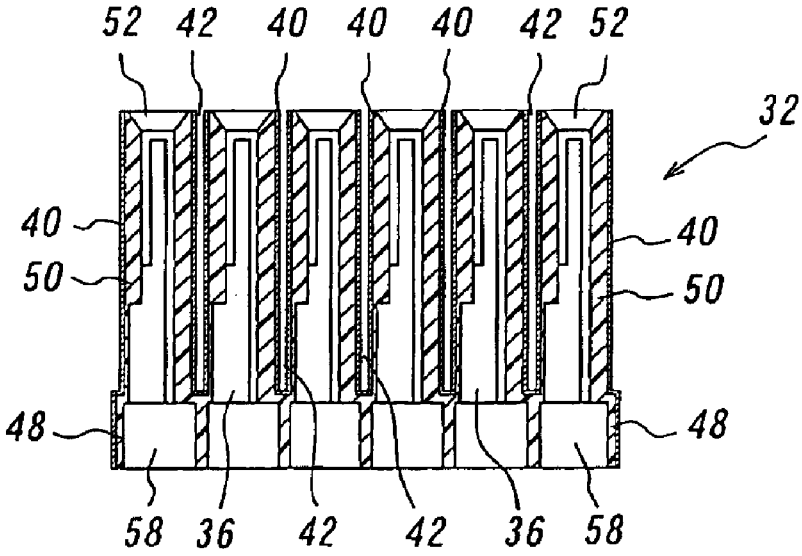
FIG. 4B is a sectional view of the housing shown in FIG. 2 taken along a plane including the contact insertion apertures in a row.
Figure 5:
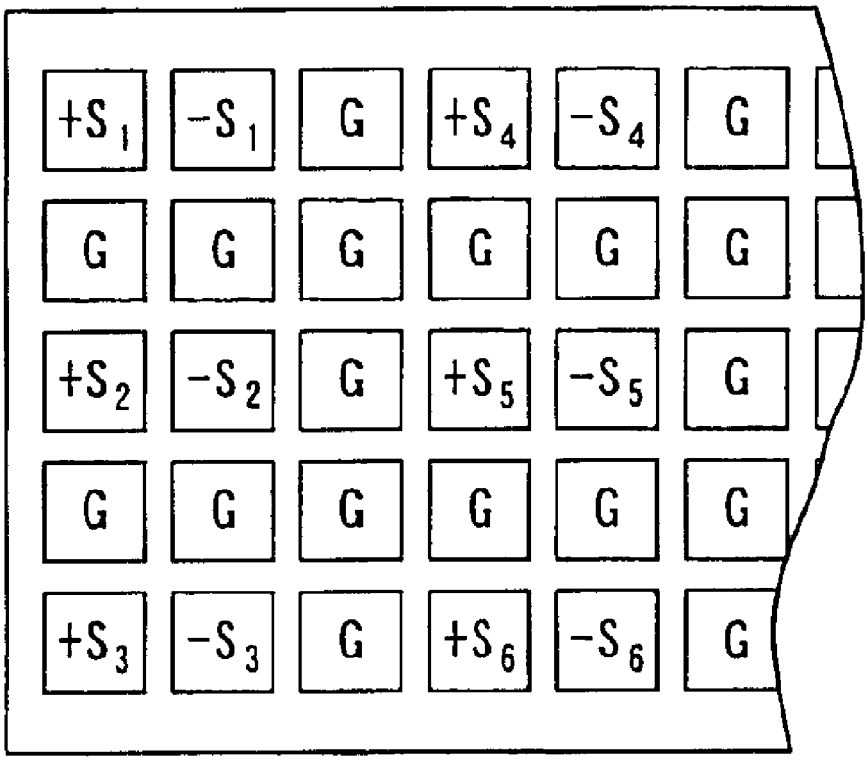
FIG. 5 PRIOR ART
FIG. 5 illustrates one exemplary arrangement of signal contacts and ground contacts of the prior art.

FIG. 1 illustrates in a perspective view the electrical connector 1 comprising the pin connector 10 and the socket connector 30 whose respective block 12 and housing 32 are shown in FIG. 2. FIGS. 3A and 3B are cross-sectional views of the block 12 taken along planes passing through centers of contact insertion apertures in column and row, respectively. FIGS. 4A and 4B are cross-sectional views of the housing 32 taken along planes passing through centers of contact insertion apertures in column and row, respectively.

Respective components of the pin connector 10 and the socket connector 30 will be explained, particularly with their constructions, herebelow.

The pin connector 10 comprises a block 12 and pin contacts 14 and ground contacts 18. The block 12 is substantially U-shaped as shown in FIG. 3A and is formed with a plurality of contact insertion apertures 16 for holding and fixing the respective pin and ground contacts 14 and 18. The surfaces of the block 12 are metallized around the bottom portion provided with the contact insertion apertures 16. The metalized surfaces layers are denoted by reference numeral 20. The layers 20 of metallization are shown in FIGS. 3A, 3B, 4A and 4B, whose thickness is on an exaggerated scale. The block 12 is formed with slit shape grooves 22 on either one, or both, of the fitting side of the block 12 and the connecting side to a board to make the pin contacts independent from one another.

The "fitting side of the block" used herein means that side of the block 12 on which the housing 32 of the socket connector 30 is fitted in the space 26 defined by the U-shaped block 12 of the pin connector 10. On the other hand, the "connecting side to a board" used herein means the opposite side of the "fitting side of the block", that is, the side on which the pin contacts are connected to a board.

The block 12 is further formed about the ground contacts with at least one groove 22 and with at least one further groove portion 24 for communicating the slit shape groove 22 around the ground contacts with the contact insertion aperture 16 for the ground contacts 18. Whereas the grooves 22 may be provided on both the sides of the ground contacts 18 as shown in FIG. 1, the grooves 22 may be provided in column and rows to surround the respective ground contacts 18. Employing such grooves 22 and groove portion 24 can allow metallization on these portions, by means of which shielding effect is provided to reduce the cross talk and to realize the high speed transmission.

Further, the groove portions 24 are beneficial for earthing of the ground contacts 18. The groove portion 24 may be only one and may extend parallel with or vertically to the two grooves 22 on both the sides of the ground contacts 18 or may be "cross-shaped" or X-shaped. The more the number of the groove portions 24, the better is the result of earthing of the ground contacts 18.

The depths of the grooves 22 and groove portions 24 may be suitably determined in consideration of the strength of the block 12 and the purposes of these grooves. The cross-sectional shape of the contact insertion aperture 16 may be rectangular as shown, but may be circular if it is for a single contact. The cross-sectional shape may be elliptical for more than one contact.

Aside from the procedure of the metallization which will be explained later, the contact insertion apertures 16 for respectively inserting the pin contacts 14 are electrically insulated independently from one another. In other words, the block 12 including grooves 22 and groove portions 24 is metallized in its entirety with exception of the fitting surfaces of the contact insertion apertures 16 to contact the pin contacts 14 and the surface on the side of tail portions or connection portions of the pin contacts 14.

The pin contacts 14 and the ground contacts 18 are fixed in the contact insertion apertures 16 by press-fitting, hooking or lancing or the like. The pin contact 14 consists mainly of a contact portion to contact a mating contact, a fixed portion to be fixed to the block 12 and a connection portion to be connected to a board or substrate. The connection portion extending from the block 12 may be of the straight dip type, surface mounting type (SMT), or L-shaped dip type.

In the shown embodiment, two pin contacts 14 arranged in one column form a pair of contacts (consisting of one signal contact and one phase inversion signal contact) and each ground contact 18 is arranged between two pairs of pin contacts 14. In other words, there are five contact insertion apertures 16 in each one column, and the contacts are arranged therein, in that order, two pin contacts 14, one ground contact 18, and two pin contacts 14 in the shown embodiment. Three pin contacts 14 may from one set of contacts and one ground contact 18 may be arranged between two sets of pin contacts 14, or one ground contact 18 may be two pin contacts 14 in accordance with a specification of the relevant connector. Although the five rows of the contacts are shown in FIGS. 1 and 2, it is to be understood that eight rows of the contacts may be used.

While each ground contact 18 is arranged between two pairs of pin contacts 14 in columns in the shown embodiment, it will be apparent that such an arrangement of the pin and ground contacts may be employed in rows. Similarly to the column, each the ground contact may be arranged between two pairs of pin contacts in the row or between two sets of pin contacts, each set consisting of three pin contacts in the row.

The socket connector 30 comprises a housing 32, and socket contacts 34 and ground contacts 38. The housing 32 is substantially in the form of a square block having two ridges each one side of its one end as shown in FIGS. 2 and 4A. The housing 32 is formed with contact insertion apertures 36 for inserting and fixing therein socket contacts 34 and ground contacts 38. The housing 32 is further formed on its fitting side with groove portions 42 to make independent the contact insertion apertures 36 for the socket contacts 34 from one another and is further formed with at least one slit shape groove portion 42 around the contact insertion apertures 36 for the ground contacts 38. A plurality of groove portions 42 may be provided on both the sides of the ground contacts 38 as shown in FIG. 1 or may be provide so as to surround the respective ground contacts 38.

After providing these groove portions 42, the groove portions 42 are metallized around the contact insertion apertures 36 as shown by numerals 40 to provide shielding effect, thereby reducing the cross talk and achieving the high speed transmission. The depth of the groove portions 42 is suitably determined in consideration of the strength of the housing 32 and the purpose of the groove portions 42. The housing 32 of the socket connector 30 comprises a main portion 48 in the form of a substantially flat plate and a plurality of projections 50 divided by the groove portions 42 and extending from the main portion 48. The contact insertion apertures 36 pass through the projections 50 and the main portion 48.

With the shown embodiment, the housing 32 is metallized on its main portion 48 and the projections 50 shown by reference numerals 40 with exception of the fitting surfaces of the contact insertion apertures 36 to contact the socket contacts 34 and the surface on the side of tail portions or connection portions of the socket contacts, thereby electrically insulating the respective contacts independently from one another. In this embodiment, as shown in FIGS. 1 and 2 there are five contact insertion apertures in one column, and two contact insertion apertures 36 for the socket contacts 34 form one pair of apertures for the socket contacts 34 and one contact insertion aperture 36 for one ground contact 38 is arranged between two pairs of apertures 36 for the socket contacts 34.

The cross-sectional shape of the contact insertion aperture 36 may be rectangular as shown, but may be circular if it is for a single contact. The cross-sectional shape may be elliptical for more than one contact. Preferably, the contact insertion aperture 36 is provided at its insertion end with a frustoconical guide 52 for the contact to be inserted thereinto as shown in FIG. 4A. The end of the frustoconical guide 52 contiguous to the contact insertion aperture 36 preferably has a diameter just as large as or slightly smaller than that of the contact insertion aperture 36 for its purpose.

The socket contacts 34 and the ground contacts 38 are fixed in the contact insertion apertures 36 in the housing 32 by press-fitting, hooking or lancing or the like. The socket contact 34 consists mainly of a contact portion to contact a mating contact, a fixed portion to be fixed to the housing 32 and a connection portion to be connected to a board or substrate. The connection portion extends from the housing 32 and may be of the straight dip type, surface mounting type (SMT), or L-shaped dip type. Required numbers of the socket contacts 34 and the ground contacts 38 are embedded in an insulator by integrally molding them to form an integral contact assembly 56 as shown in FIG. 1 which is adapted to be fitted and fixed in an engaging bore 58 formed in the housing 32 as shown in FIG. 4A.

In the shown embodiment, two socket contacts 34 arranged in one column form a pair of contacts (signal contact and phase inversion signal contact) and each ground contact 38 is arranged between two pairs of socket contacts 34. In other words, there are five contact insertion apertures 36 in each one column, and the contacts are arranged therein, in that order, two socket contacts 34, one grand contact 38 and two socket contacts 34 as shown in FIGS. 1 and 2. As an alternative, three socket contacts 34 may form one set of contacts and one ground contact 38 may be arranged between two sets of socket contacts 34, or one ground contact 38 may be arranged between two socket contacts 34 in accordance with a specification of the relevant connector. Other than the case of the five rows of the contacts shown in FIG. 1, eight rows of the contacts may also be employed.

In the illustrated embodiment, each ground contact 38 is arranged between two pairs of the socket contacts 34 in columns as described above. However, such an arrangement of the socket and ground contacts may be employed in rows. Namely, each the ground contact may be arranged between two socket contacts 34 in one row or between two sets of socket contacts 34 in one row. One set of socket contacts 34 may consist of more than two socket contacts 34.

Among the contact insertion apertures of the pin and socket connectors 10 and 30, the contact insertion apertures 16 and 36 for the ground contacts 18 and 38 only may be metallized on their inner surfaces. As described above, the surfaces of the block and housing are metallized "around" the contact insertion apertures. Namely, the block 12 of the pin connector 10 and the housing 32 of the socket connector 30 are metallized on their surfaces with exception of the fitting surfaces of the contact insertion apertures 16 and 36 for the pin and socket contacts 14 and 34 and the surfaces of the block 12 and housing 32 on the side of the tail portions or connection portions of the contacts. The metallization in this manner not only contributes to the electric conductivity of the block 12 and the housing 32 but also permits the contact insertion apertures 16 and 36 for the pin and socket contacts 14 and 34 to be electrically insulated independently from one another.

The procedure for metallizing the block 12 and the housing 32 will be explained hereinafter. As described above, the metallization is understood as signifying the condition of an insulator coated on its surface with a metal film so as to be electrically conductive. In order to carry out the metallizing, the insulator may be surface treated to make electrically conductive as by electroless plating or vapor deposition (vacuum evaporation). Preferred metals for the metallization include copper, nickel and the like in consideration of the shield effect and conductivity.

In order to electrically insulate the contact insertion apertures 16 and 36 for the pin and socket contacts 14 and 34 independently from one another, after the whole insulators (block 12 and housing 32) have been metallized, the metallized surfaces of fitting portions of the contact insertion apertures and of the insulators on the side of tail ends or connection portions of the contacts are treated to remove their metallized layers by working by means of end mills or grinder or treating by means of blasting or chemical etching. As an alternative, preparatory to the metallization, masking is used on such surface portions which are undesirable to be metallized. In the illustrated embodiment, the masking is employed for reasons of economy and performance.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector comprising a pin connector and a socket connector, said pin connector including a plurality of pin contacts, a required number of ground contacts and a block for holding said pin and ground contacts, said block including a fitting side and a connecting side for connecting to a board, and said socket connector including a plurality of socket contacts, a required number of ground contacts and a housing for holding said socket and ground contacts, wherein said block and housing are each formed from an insulating plastic material and formed with contact insertion apertures into which said contacts are inserted, and said block and housing each have metalized surfaces fully around said contact insertion apertures in a manner to electrically shield said contact insertion apertures for pin and socket contacts independently from one another, wherein said block of said pin connector is formed with grooves on either one, or both, of the fitting side of said block and the connecting side to a board to make independent said pin contacts from one another, while said block is provided with at least one groove portion around said ground contacts and with at least one further groove portion to communicate said at least one groove portion with said contact insertion apertures for said ground contacts, and wherein said housing of said socket connector is formed with groove portions on the fitting side of said housing to make independent said socket contacts from one another, while said housing is provided with at least one groove or groove portion around said ground contacts, and wherein said block of said pin connector is metallized on its surfaces around said contact insertion apertures for said pin contacts, while said ground contacts are each arranged between the pin contacts in columns or rows, and wherein said housing of said socket connector is metallized on its surfaces around said contact insertion apertures for said pocket contacts, while said ground contacts of said socket connector are arranged in positions corresponding to those of said wound contacts of said pin connector.

2. The electrical connector as set forth in claim 1 wherein said pin contacts of said pin connector form respective pairs of pin contacts, each consisting of the two pin contacts, and said block of the pin connector is formed with grooves on either, or both, of the fitting side of said block and the connecting side to a board to make independent the pairs of pin contacts from one another, while said block is provided with at least one groove around said ground contacts and with at least one further groove portion to communicate said at least one groove with said contact insertion apertures for said ground contacts, and wherein said socket contacts of said socket connector form respective pairs of socket contacts, each consisting of the two socket contacts, and said housing of said socket connector is formed with grooves or groove portions on the fitting side of said housing to make independent the pairs of socket contacts from one another, while said housing is provided with at least one groove or groove portion around said ground contacts.

3. The electrical connector as set forth in claim 2 wherein said block of said pin connector is metallized on its surfaces around pairs of said contact insertion apertures for said pin contacts, while said ground contacts are each arranged between two pairs of pin contacts in columns or rows, and wherein said housing of said socket connector is metallized on its surfaces around pairs of said contact insertion apertures for said socket contacts, while said ground contacts of said socket connector are arranged in positions corresponding to those of said ground contacts of said pin connector.

4. The electrical connector as set forth in claim 1 wherein said pin contacts of said pin connector form respective sets of pin contacts, each consisting of three or more of the pin contacts, and said block of the pin connector is formed with grooves on either, or both, of the fitting side of said block and the connecting side to a board to make independent the sets of the pin contacts from one another, while said block is provided with at least one groove around said ground contacts and with at least one further groove to communicate said at least one groove with said contact insertion apertures for said ground contacts, and wherein said socket contacts of said socket connector form respective sets of the socket contacts, each consisting three or more of the socket contacts, and said housing of said socket connector is formed with grooves on the fitting side of said housing to make independent the sets of the socket contacts from one another, while said housing is provided with at least one groove around said ground contacts.

5. The electrical connector as set forth in claim 4 wherein said block of said pin connector is metallized on its surfaces around sets of said contact insertion apertures for said sets of pin contacts, while said ground contacts are each arranged between two sets of said pin contacts in columns or rows, and wherein said housing of said socket connector is metallized on its surfaces around sets of said contact insertion apertures for said sets of socket contacts, while said ground contacts of said socket connector are arranged in positions corresponding to those of said ground contacts of said pin connector.

6. The electrical connector as set forth in claims 3 wherein said housing of said socket connector comprises a main portion in the form of a substantially flat plate, and a plurality of projections extending from said main portion, said contact insertion apertures passing through said main portion and said projections, and said main portion and said projections are metallized on their substantially entire surfaces so as to allow said contact insertion apertures for said socket contacts to be electrically insulated independently from one another.

7. The electrical connector as set forth in claim 5 wherein said housing of said socket connector comprises a main portion in the form of a substantially flat plate, and a plurality of projections extending from said main portion, said contact insertion apertures passing through said main portion and said projections, and said main portion and said projections are metallized on their substantially entire surfaces so as to allow said contact insertion apertures for said socket contacts to be electrically insulated independently from one another.

8. The electrical connector as set forth in claim 3 wherein said contact insertion apertures for said ground contacts only are metallized.

9. The electrical connector as set forth in claim 5 wherein said contact insertion apertures for said ground contacts only are metallized.

10. The electrical connector as set forth in claim 2 wherein said at least one further groove provided in said block of said pin connector for communicating said at least one groove with said contact insertion apertures for said ground contacts extends parallel with or normal to a row or column of said ground contacts or is plus or cross-shaped or X-shaped.

11. The electrical connector as set forth in claim 4 wherein said at least one further groove provided in said block of said pin connector for communicating said at least one groove with said contact insertion apertures for said ground contacts extends parallel with or normal to a row or column of said ground contacts or is plus or cross-shaped or X-shaped.

* * * * *